US008210520B2

(12) United States Patent
Su et al.

(10) Patent No.: US 8,210,520 B2
(45) Date of Patent: Jul. 3, 2012

(54) DOCUMENT FEEDING MECHANISM HAVING STOPPER MEANS

(75) Inventors: Pai-Hsien Su, Taipei (TW); Shao-Yang Wu, Taipei (TW); Yueh-Shing Lee, Taipei (TW); Shao-Jen Chuang, Taipei (TW)

(73) Assignee: Foxlink Image Technology Co., Ltd., Taipei (TW)

( * ) Notice: Subject to any disclaimer, the term of this patent is extended or adjusted under 35 U.S.C. 154(b) by 0 days.

(21) Appl. No.: 13/117,388

(22) Filed: May 27, 2011

(65) Prior Publication Data

US 2012/0056368 A1 Mar. 8, 2012

Related U.S. Application Data

(62) Division of application No. 12/875,480, filed on Sep. 3, 2010, now Pat. No. 8,052,139.

(51) Int. Cl.
*B65H 3/52* (2006.01)

(52) U.S. Cl. ..... 271/117; 271/109; 271/121

(58) Field of Classification Search ..... 271/109, 271/117, 121
See application file for complete search history.

(56) References Cited

U.S. PATENT DOCUMENTS

| | | | | |
|---|---|---|---|---|
| 5,082,270 | A * | 1/1992 | Kamezaki | 271/109 |
| 5,411,247 | A * | 5/1995 | Ohsawa | 271/119 |
| 6,792,241 | B2 * | 9/2004 | Nakagawa et al. | 399/367 |
| 7,516,953 | B2 * | 4/2009 | Lee | 271/117 |
| 7,543,811 | B2 * | 6/2009 | Shimamura | 271/124 |
| 8,042,800 | B2 * | 10/2011 | Hsu | 271/121 |
| 8,052,139 | B1 * | 11/2011 | Su et al. | 271/117 |
| 8,061,705 | B1 * | 11/2011 | Su et al. | 271/117 |
| 2007/0001375 | A1 * | 1/2007 | Zhu | 271/117 |
| 2008/0054549 | A1 * | 3/2008 | Lee | 271/117 |
| 2008/0197560 | A1 * | 8/2008 | Lee et al. | 271/121 |
| 2010/0244368 | A1 * | 9/2010 | Lin | 271/121 |
| 2011/0115147 | A1 * | 5/2011 | Hsu | 271/109 |

* cited by examiner

*Primary Examiner* — Jeremy R Severson

(74) *Attorney, Agent, or Firm* — WPAT, P.C.; Anthony King

(57) ABSTRACT

A document feeding mechanism includes a frame, a document picking means positioned in the frame for picking up and conveying a document, a stopper means positioned in the frame for blocking the conveyance of the document, a supporting portion cooperating with the stopper means for supporting the document picking up means while the document picking up means is raised at a predetermined level, and a blocking portion restricting a rotatable angle of the stopper means for blocking the conveyance of the document while the document picking up means is raised at the predetermined level. The document feeding means is kept at the predetermined level via the cooperation of the supporting portion and the stopper means for supporting the document feeding means. Since, the document feeding mechanism has high reliability to resist shake and crash for preventing the document picking up means from being drooped.

7 Claims, 11 Drawing Sheets

DOCUMENT FEEDING MECHANISM HAVING STOPPER MEANS

CROSS-REFERENCE TO RELATED APPLICATIONS

This application is a Divisional of the pending U.S. patent application Ser. No. 12/875,480 filed on Sep. 3, 2010, all of which is hereby incorporated by reference in its entirety.

Although incorporated by reference in its entirety, no arguments or disclaimers made in the parent application apply to this divisional application. Any disclaimer that may have occurred during the prosecution of the above-referenced application(s) is hereby expressly rescinded. Consequently, the Patent Office is asked to review the new set of claims in view of the entire prior art of record and any search that the Office deems appropriate.

BACKGROUND OF THE INVENTION

1. Field of the Invention

The present invention relates to a document feeding mechanism, more specifically, to a high reliability document feeding mechanism.

2. The Related Art

Please refer to FIG. 1 and FIG. 2. A conventional document feeding mechanism 900 includes a document guiding frame 902, a document picking up means 904 and a pair of stopper means 906. The document guiding frame 902 includes a document supporting platform 908 formed at a front portion thereof for supporting a front portion of a document. The document supporting platform 908 is formed a pair of grooves 910 at a central portion thereof.

The document picking up means 904 includes a supporting frame 912, a separating roller 914 and a picking up roller 916. The supporting frame 912 includes a pair of side walls 918, a block 920 laterally protruding from one of the side walls 918, and a barrel 922 protruding from the other side wall 918. The block 920 is capable of restricting the rotatable angle of the stopper means 906.

The separating roller 914 is arranged a spring 924 at one lateral end thereof. The spring 924 arranged around one lateral end of the separating roller 914 is received in the barrel 922. Each of the stopper means 906 includes a connection portion 926, a blocking portion 928 extending downwardly from the connection portion 926, and a pair of restricting arms 930 respectively extending upwardly from the connection portion 926.

The blocking portion 928 of the stopper means 906 extends into the groove 910 for blocking the document. The restricting arms 930 of the stopper means 906 are capable of abutting against the block 920 of the supporting frame 912 if the stopper means 906 pivots on the connection portion 926 thereof.

If the document feeding mechanism 900 works, the separating roller 914 will be driven to rotate by a driving motor (not shown in figures). The rotation of the separating roller 914 brings the spring 924 to abut against an inner surface of the barrel 922 of the supporting frame 912. Since, the supporting frame 912 will be raised to a predetermined level for putting a bundle of documents on the document supporting platform 908.

Because the supporting frame 912 is kept at the predetermined level by the friction between the spring 924 and the barrel 922, the supporting frame 912 may be easily slipped by crashing or shaking. Since, the document feeding mechanism 900 has low reliability for picking up the document.

SUMMARY OF THE INVENTION

An object of the present invention is to provide a document feeding mechanism has high reliability.

According to the invention, the document feeding mechanism includes a frame, a document picking up means, a stopper means, a supporting portion and a blocking portion. The document picking means is positioned in the frame for picking up and conveying a document. The stopper means is positioned in the frame for blocking the conveyance of the document.

The supporting portion cooperates with the stopper means for supporting the document picking up means while the document picking up means is raised at a predetermined level. The blocking portion restricts a rotatable angle of the stopper means for blocking the conveyance of the document while the document picking up means is raised at the predetermined level.

Since, the document feeding means is kept at the predetermined level via the cooperation of the supporting portion and the stopper means for supporting the document feeding means. Since, the document feeding mechanism has high reliability to resist shake and crash for preventing the document picking up means from being drooped.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
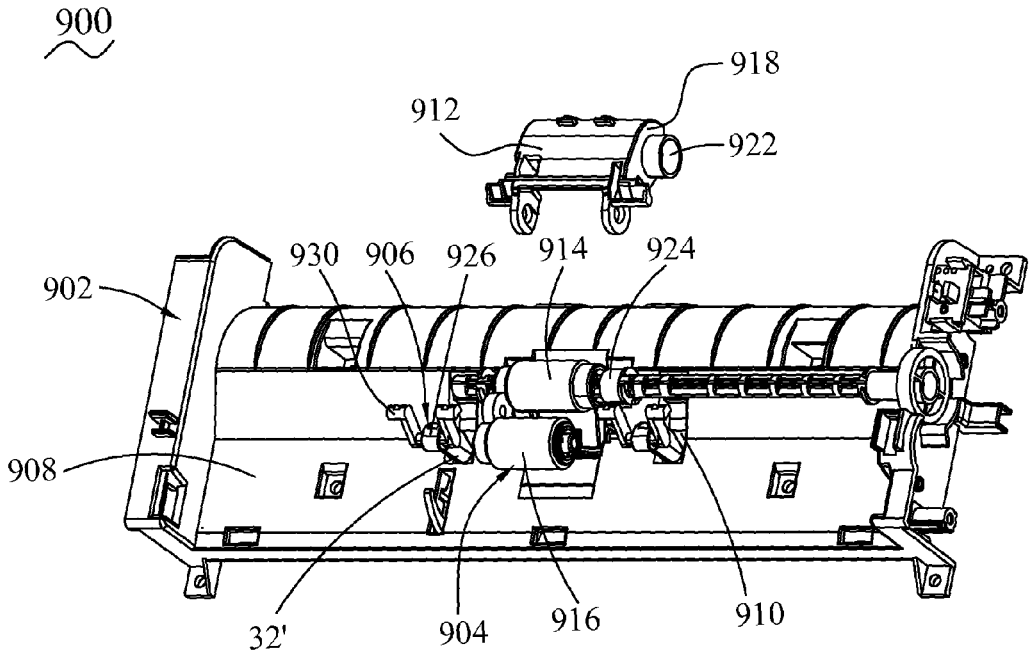
FIG. 1(Prior Art)
FIG. 1 is an exploded view of a conventional document feeding mechanism.
Figure 2:
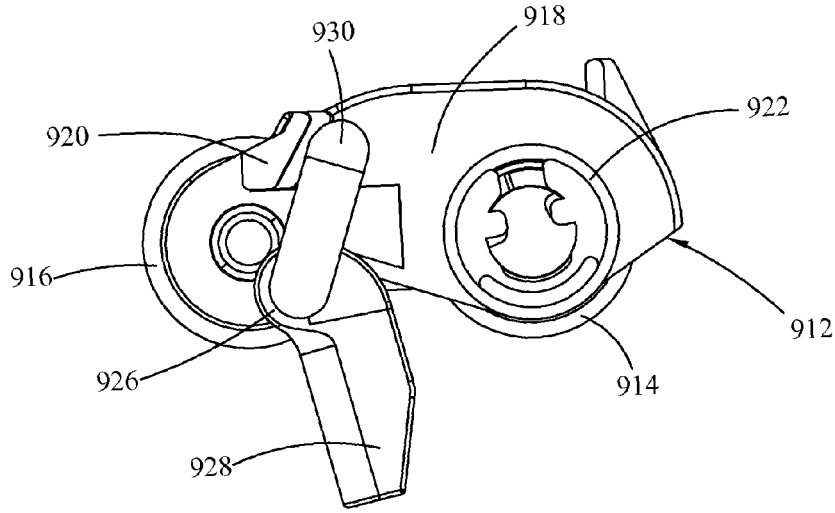
FIG. 2(Prior Art)
FIG. 2 is a side view showing a document picking up means of the document feeding mechanism.
Figure 3:
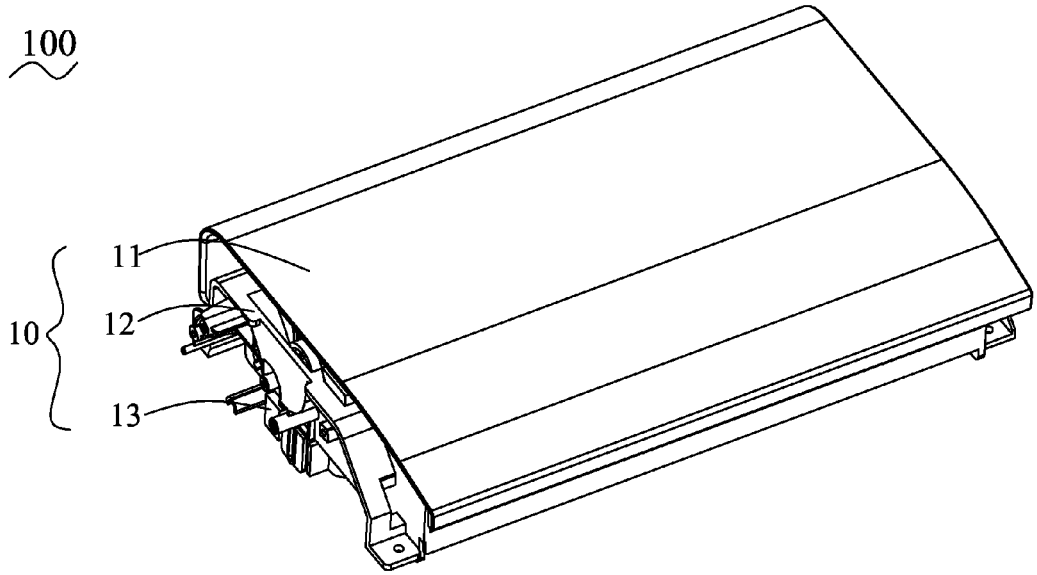
FIG. 3 is a perspective view of a document feeding mechanism according to the present invention.
Figure 4:
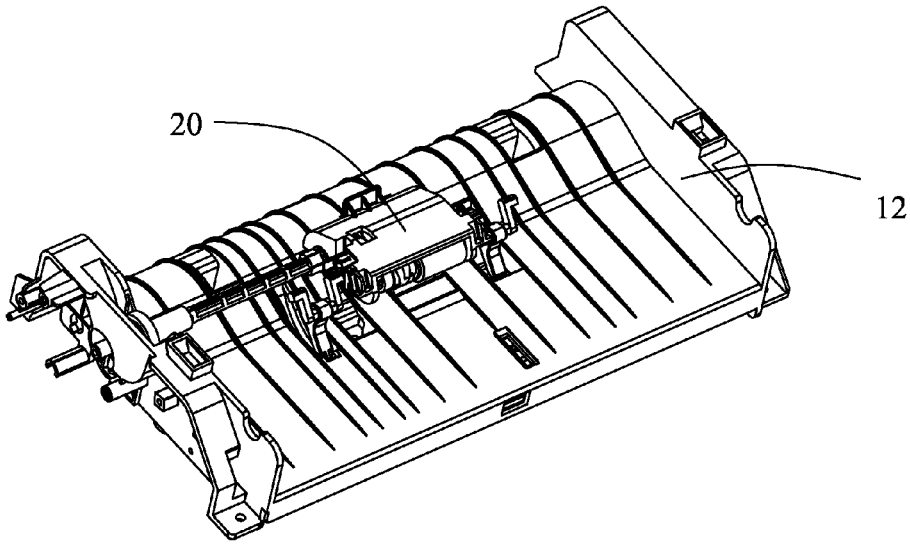
FIG. 4 is a perspective view showing an upper guiding frame and a first preferred embodiment of a document picking up means according to the present invention.
Figure 5:
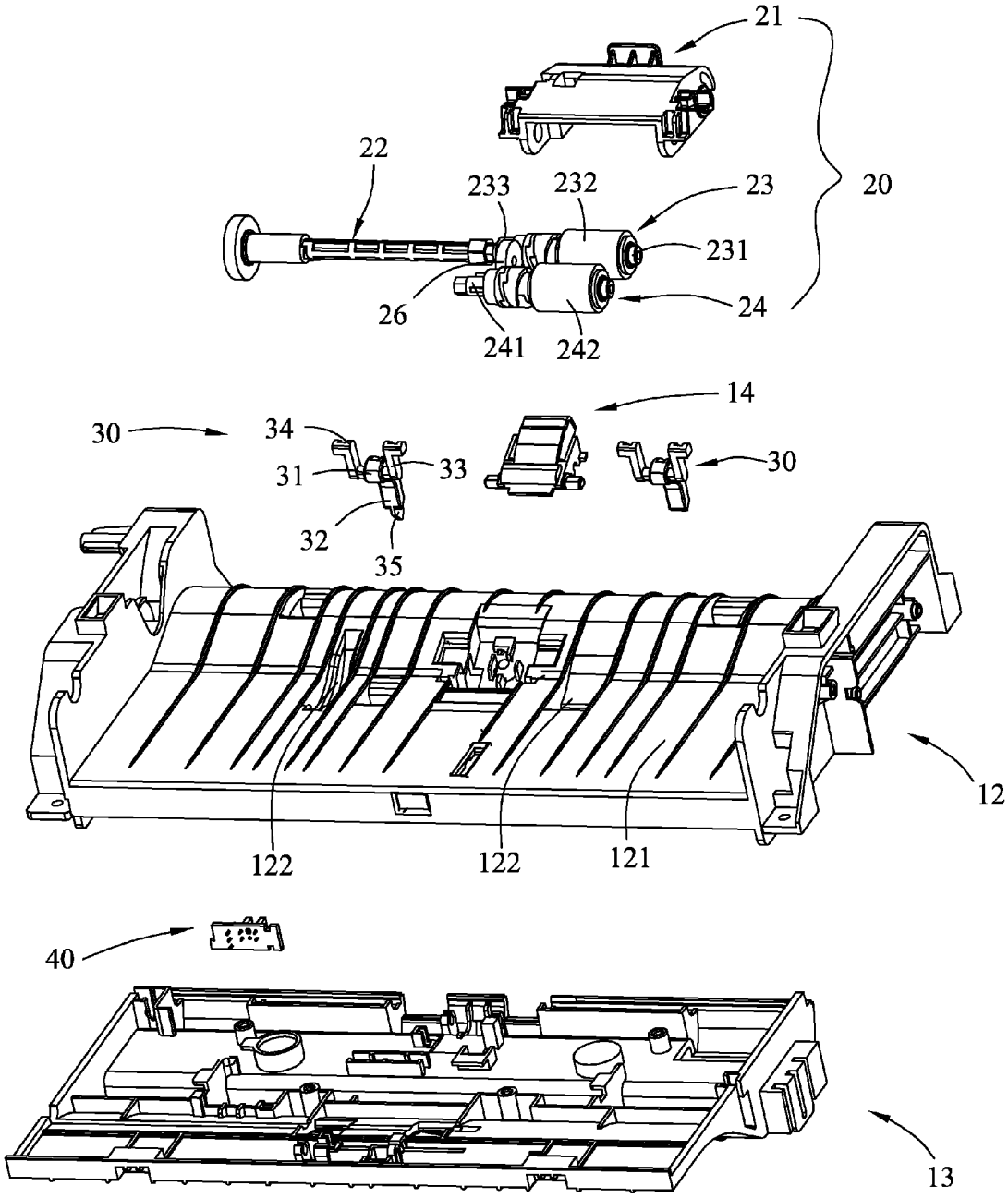
FIG. 5 is an exploded view showing the upper guiding frame and the first preferred embodiment of the document picking up means according to the present invention.
Figure 6:
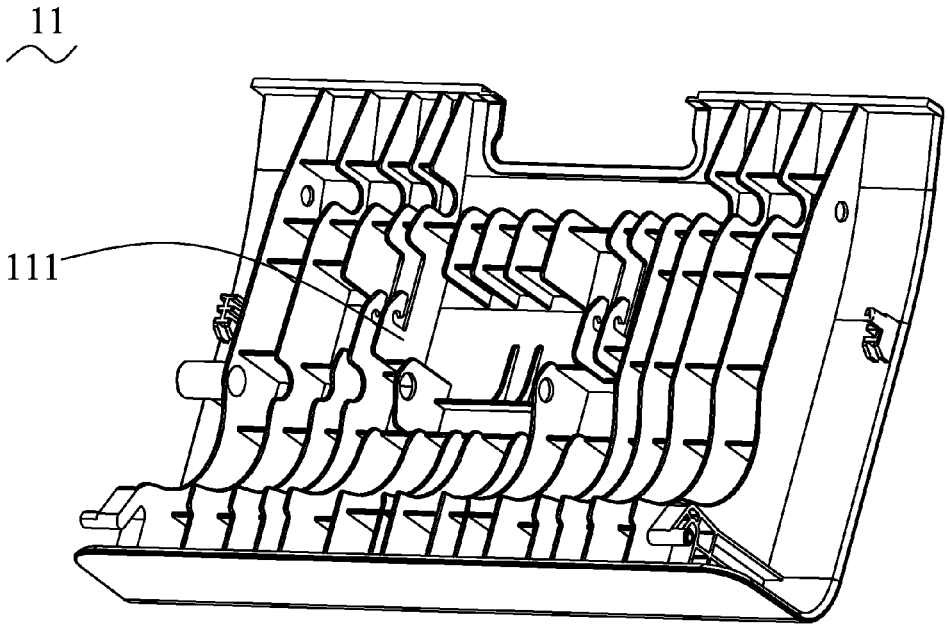
FIG. 6 is a perspective view of a cover of the document feeding mechanism according to the present invention.
Figure 7:
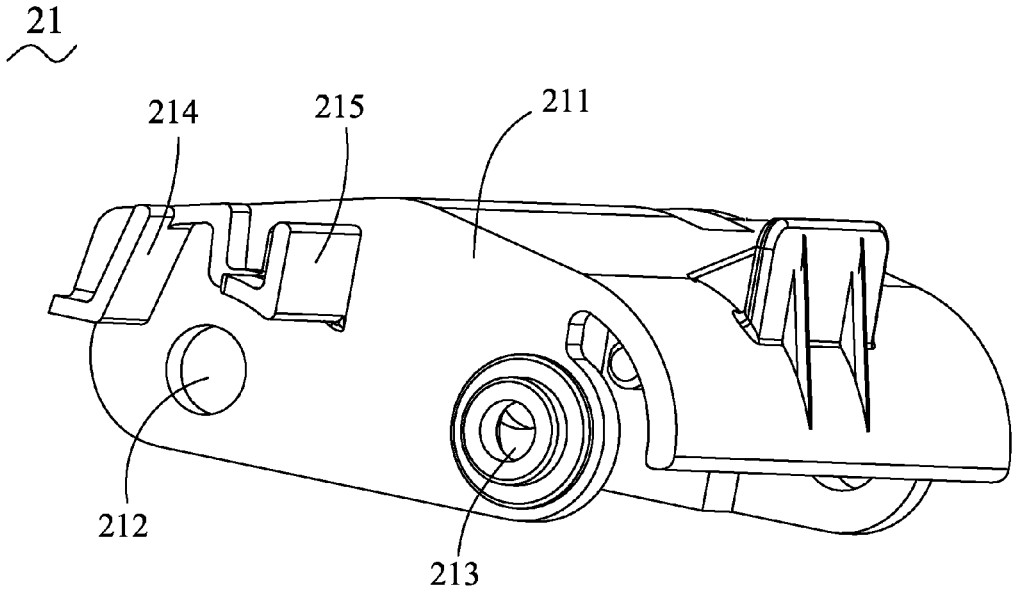
FIG. 7 is a perspective view of a supporting frame of the first preferred embodiment of the document picking up means according to the present invention.

Please refer to FIG. 3 to FIG. 7. A document feeding mechanism 100 includes a frame 10, a document picking up means 20, a pair of stopper means 30 and a sensor 40. The frame 10 includes a cover 11, an upper guider 12 and a lower guider 13. The upper guider 12 and the lower guider 13 are assembled to a document guiding frame which is coved by the cover 11.

The cover 11 includes a plurality of ribs 111 protruding downwardly and extending from the front direction and to the rear direction. The upper guider 12 includes a document supporting platform 121 formed at a front portion thereof and connected to a document input tray (not shown in figures), which is capable of supporting a front portion of a document.

The document supporting platform 121 includes a pair of grooves 122 formed at a central portion thereof. The grooves 122 are respectively formed as a rectangular shape and extending from the front direction and to the rear direction. Especially, the grooves 122 penetrate the document supporting platform 121 from the top direction and to the down direction. A separating pad unit 14 is positioned on the upper guider 12.

The document picking up means 20 couples to the ribs 111 of the cover 11. A first preferred embodiment of the document picking up means 20 includes a supporting frame 21, a driving shaft 22, a document separating unit 23 and a document picking up unit 24. The supporting frame 21 includes a pair of side walls 211, a first hole 212 formed at a front portion of each side wall 211, a second hole 213 formed at a rear portion of each side wall 211, a first blocking portion 214 laterally protruded from the front portion of each side wall 211, and a first supporting portion 215 laterally protruded from each side wall 211 and behind the first blocking portion 214. Especially, the first blocking portion 214 is separated from the first supporting portion 215 to keep a space there between.

The driving shaft 22 couples to the cover 11 and interconnects the document separating unit 23 and a motor (not shown in figures). The document picking up unit 24 includes a shaft 241 and a picking up roller 242 surrounding the shaft 241. The shaft 241 of the document picking up unit 24 couples to the first hole 212 of the supporting frame 21. Especially, the picking up roller 242 is made of a high friction material.

The document separating unit 23 includes a shaft 231 and a separating roller 232 surrounding the shaft 231. The shaft 231 of the document separating unit 23 couples to the second hole 213 of the supporting frame 21. Especially, the separating roller 232 is made of a high friction material. One end of the shaft 231 of the separating unit 23 connected to the driving shaft 22 is surrounded by a spring 233. Especially, the spring 233 is compressed between an inner surface of the side wall 211 of the supporting frame 21 and a lateral surface of the separating roller 232. A transmitting unit 26 couples to the supporting frame 21 and interconnects the document separating unit 23 and the document picking up unit 24.

Especially, the separating roller 232 can be replaced by a separating belt and the picking up roller 242 can be replaced by a picking up belt. If the document separating unit 23 and the document picking up unit 24 works, then the motor will drive the separating unit 23 to rotate though the driving shaft 22. The document separating unit 23 brings the document picking up unit 24 to rotate through the transmitting unit 26.

Since, the picking up roller 242 picks up a document from the document supporting platform 121 and conveys the document toward the document separating unit 23. The separating roller 232 of the document separating unit 23 and the separating pad unit 14 together separate overlapped documents into a single document and conveys the single document toward the rear direction.

The stopper means 30 is capable of abutting against the first blocking portion 214 and the first supporting portion 215 of the supporting frame 21. A first preferred embodiment of each stopper means 30 includes a connection portion 31, a blocking arm 32 extending downwardly from the connection portion 31, a pair of restricting arm 33 respectively extending upwardly from the connection portion 31, and a shading portion 34 extending downwardly from the blocking arm 32.

The stopper means 30 couples to the ribs 111 of the cover 11 by the connection portion 31 thereof. The sensor 40 is positioned below one of the grooves 122. The blocking arm 32 of the stopper means 30 is extended into the groove 122 and beside the sensor 40.

Figure 8:
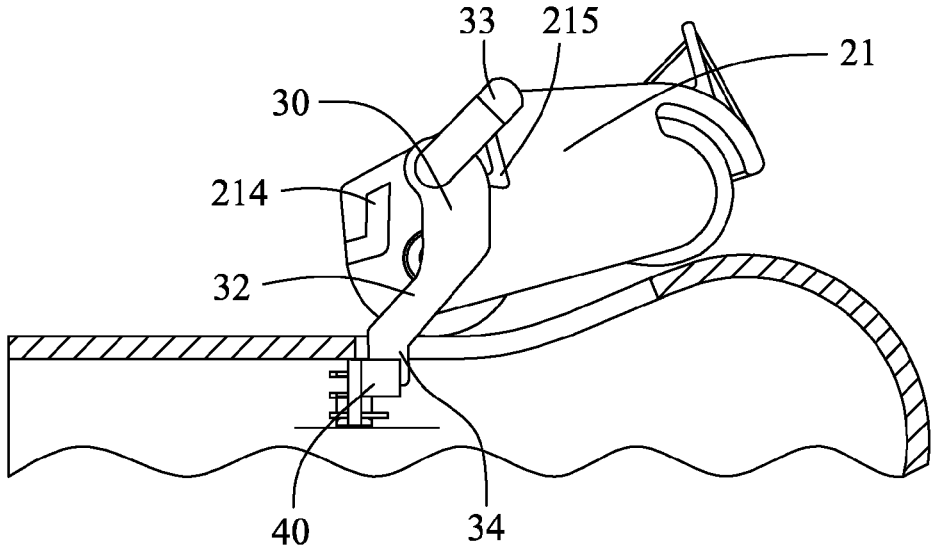
FIG. 8 shows the first preferred embodiment of the document picking up means in no document status.
Figure 9:
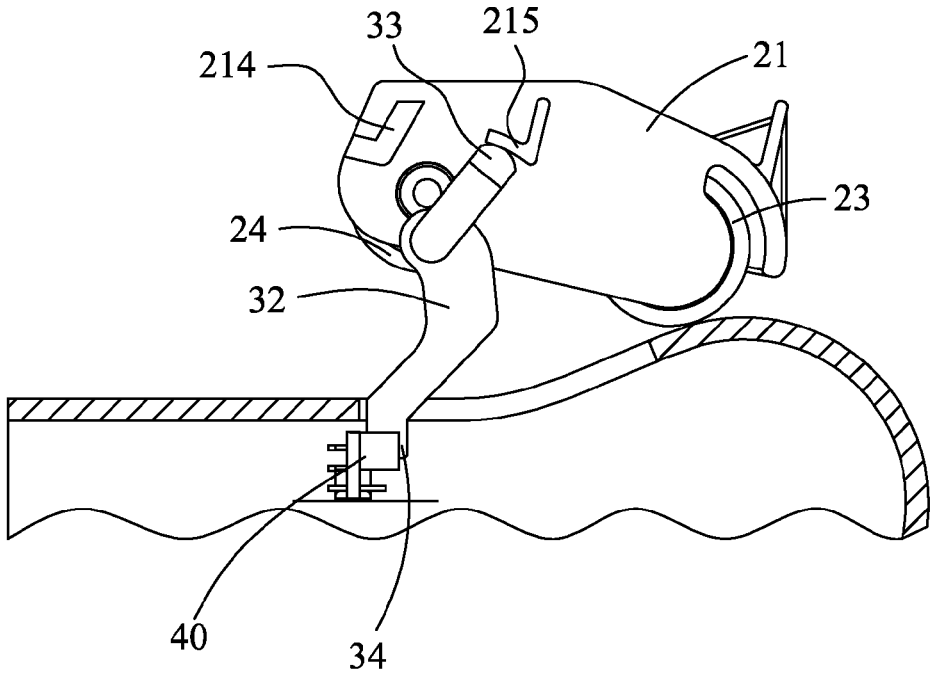
FIG. 9 shows the first preferred embodiment of the document picking up means in a status of preparing for putting documents.
Figure 10:
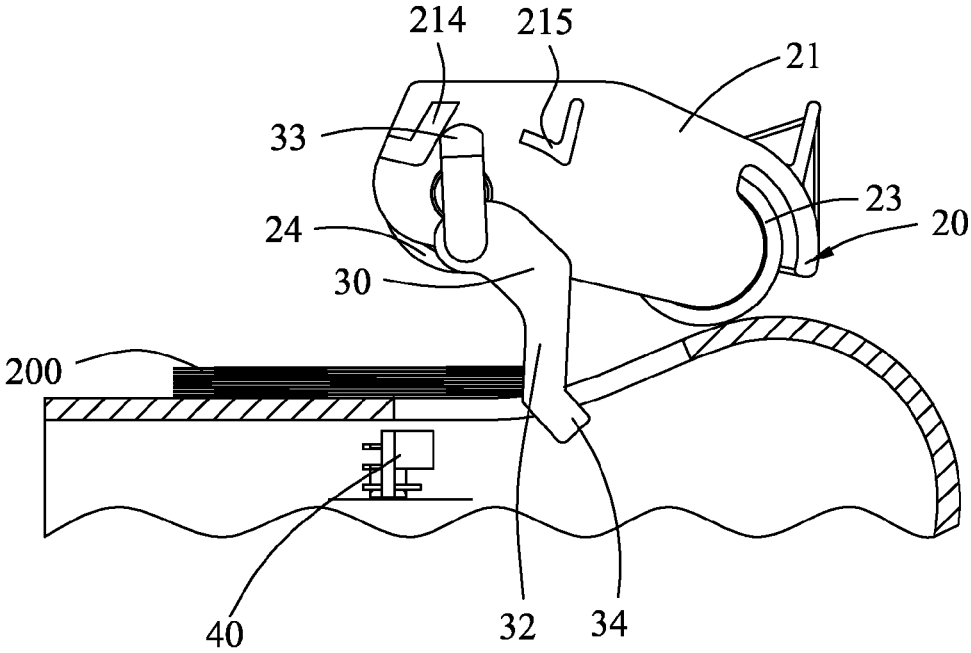
FIG. 10 shows the first preferred embodiment of the document picking up means in a status of preparing for picking up documents.
Figure 11:
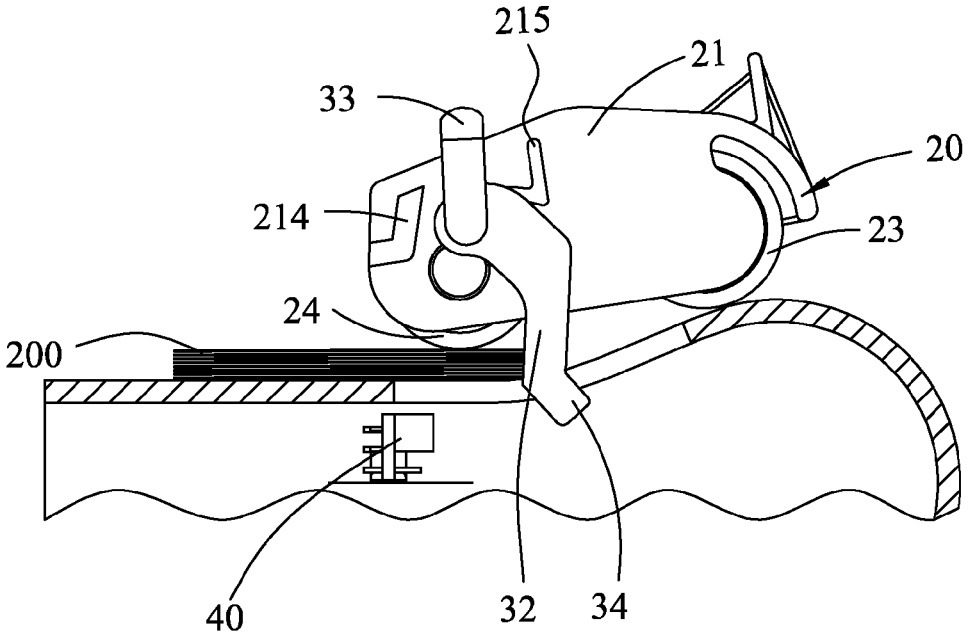
FIG. 11 shows the first preferred embodiment of the document picking up means in document feeding status.
Figure 12:
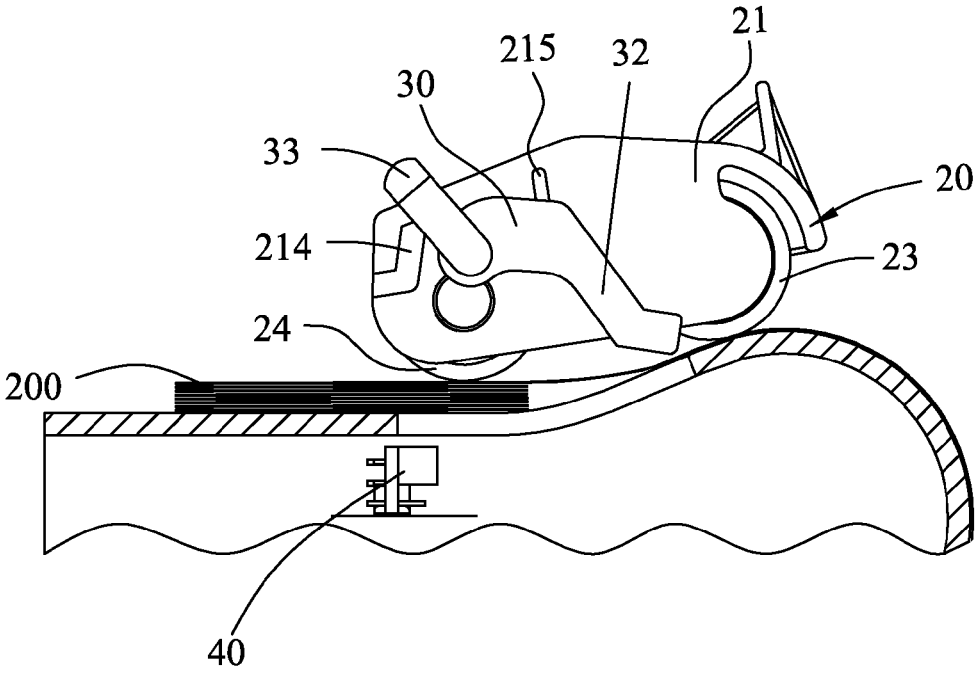
FIG. 12 shows the first preferred embodiment of the document picking up means in document separating status.

Please refer to FIG. 8 to FIG. 12. If the document feeding means 20 works in no document status, the blocking arm 32 and the shading portion 34 of the stopper means 30 will be drooped by gravity to shading the sensor 40. The restricting arm 33 of the stopper means 30 is positioned above the first blocking portion 214 and the first supporting portion 215. A processor (not shown in figures) will monitor the sensor to control the motor for driving the document picking up means 20.

Since, the driving shaft 22 and the shaft 231 of the document separating unit 23 is driven to rotate. Because a friction is formed via the spring 233 abutting against the side wall 211 of the supporting frame 21 and the separating roller 232, the document picking up means 20 will pivot on the shaft 231 of the document separating unit 23 for being urged to raise at a predetermined level.

According with movement of the supporting frame 21, the first supporting portion 215 will move upwardly behind the restricting arm 33 and then above the restricting arm 33. If the document picking up means 20 is raised at the predetermined level, then a top portion of the restricting arm 33 can abut against a bottom portion of the first supporting portion 215. Since, the document picking up means 20 is supported by the cooperation of the first supporting portion 215 and the restricting arm 33 of the stopper means 30 to improve the reliability thereof.

After the document picking up means 20 has raised at the predetermined level, the document picking up means 20 works in a status of preparing for putting documents. Since, the bundle of documents can be put on the document supporting platform 121 conveniently.

If the documents have put on the document supporting platform 121, then the blocking arm 32 of the stopper means 30 can be pushed rearward. Since, the restricting arm 33 is brought to rotate to separate from the first supporting portion 215 and move toward the first blocking portion 214, and the shading portion 34 is brought to depart from the sensor 40. Then, the restricting arm 33 abuts against a rear portion of the first blocking portion 214 to restrict rotation of the stopper means 30. Since, the documents can be blocked by the blocking arm 32 of the stopper means 30.

Because the sensor 40 is not shaded by the shading portion 34, the processor judges the document picking up means 20 is in a status of preparing for picking up documents. If the document picking up means 20 is in a status of picking up documents, then the document picking up means 20 will be driven to droop by the motor. The restricting arm 33 of the stopper means 30 is passed the space between the first blocking portion 214 and the first supporting portion 215 and then above the first blocking portion 214 and the first supporting portion 215.

The picking up roller 242 of the document picking up unit 24 is brought to connect the document for picking up the document. Because the restricting arm 33 is not blocked by the first blocking portion 214, the document is conveyed by the picking up roller 242 to push the blocking arm 32. Then, the document is conveyed toward the document separating unit 23.

After all documents has passed the document picking up unit 24 and the document separating unit 23, the blocking arm 32 and the shading portion 34 are drooped by gravity thereof. The processor judges the document picking up means 20 works in no document status by monitoring the sensor 40 shaded by the shading portion 34 of the stopper means 30. Then, the processor controls the motor to drive the document picking up means 20 to raise at the predetermined level.

Figure 13:
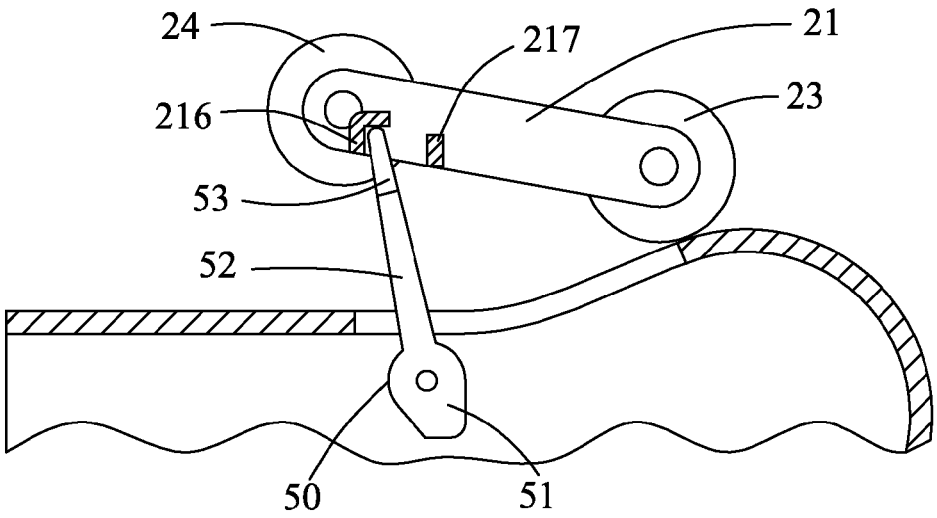
FIG. 13 shows a second preferred embodiment of the document picking up means in a status of preparing for putting documents according to the present invention.
Figure 14:
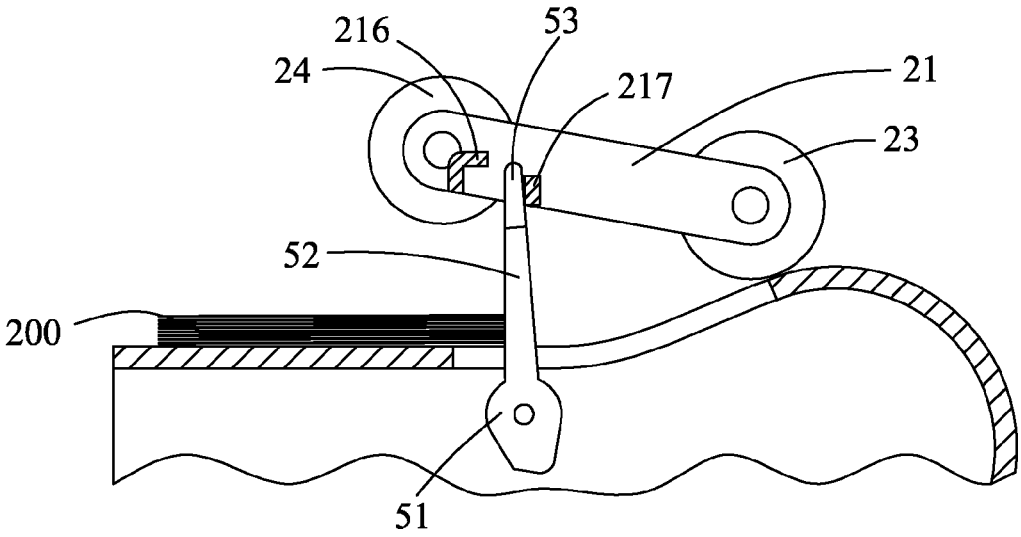
FIG. 14 shows the second preferred embodiment of the document picking up means in a status of preparing for picking up documents.
Figure 15:
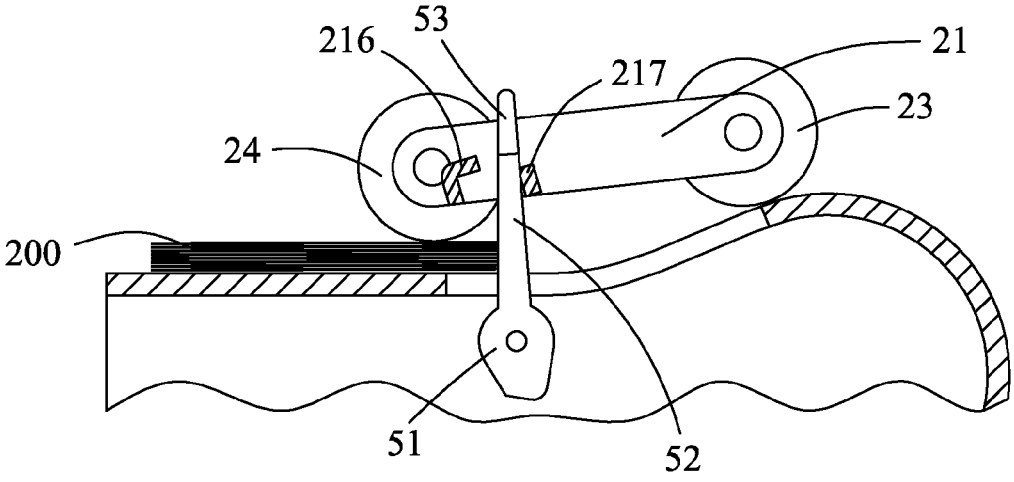
FIG. 15 shows the second preferred embodiment of the document picking up means in document feeding status.
Figure 16:
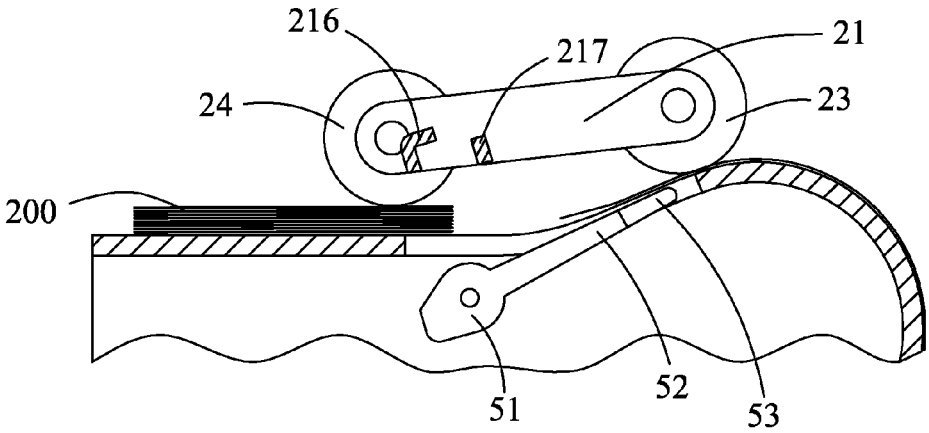
FIG. 16 shows the second preferred embodiment of the document picking up means in document separating status.

Please refer to FIG. 13 to FIG. 16 showing a second preferred embodiment of the document picking up means 20 and a second preferred embodiment of the stopper means 50. The second preferred embodiment of the document picking up means 20 includes the supporting frame 21, the document picking up unit 24 and the document separating unit 23. The supporting frame 21 includes a second supporting portion 216 laterally protruding from the front portion of each side wall 211, and a second blocking portion 217 laterally protruding from each side wall 211 and positioned behind the second supporting portion 216. Especially, the second blocking portion 217 is separated from the second supporting portion 216 to keep a space therebetween.

The second preferred embodiment of the stopper means 50 includes a connection portion 51, a blocking arm 52 extended upwardly from the connection portion 51 and a restricting arm 53 extended upwardly from the blocking arm 52. The connection portion 51 couples to the upper guider 12 of the frame 10. If the document picking up means 20 works in the status of preparing for putting documents, then the document picking up means 20 can be raised at the predetermined level. The second supporting portion 216 is abutted against and supported by the restricting arm 53 of the stopper means 50 to improve the reliability of the document picking up means 20.

If the documents are put on the document supporting platform 121, then the blocking arm 52 of the stopper means 50 can be pushed rearward. Since, the restricting arm 53 is brought to rotate to separate from the second supporting portion 216 and move toward the second blocking portion 217. Then, the restricting arm 53 abuts against the second blocking portion 217 to restrict rotation of the stopper means 50. Since, the documents can be blocked by the blocking arm 52 of the stopper means 50.

The processor judges the document picking up means 20 works in the status of preparing for picking up documents by motoring the sensor 40. If the document picking up means 20 works in the status of picking up documents, then the document picking up means 20 will be driven to droop. The restricting arm 53 of the stopper means 50 is passed the space between the second supporting potion 216 and the second blocking portion 217 and then above the second supporting portion 216 and the second blocking portion 217.

The picking up roller 242 of the document picking up unit 24 is brought to connect the document for picking up the document. Because the restricting arm 53 is not blocked by the second blocking portion 217, the document is conveyed by the picking up roller 242 to push the blocking arm 52. Then, the document is conveyed toward the document separating unit 23.

Figure 17:
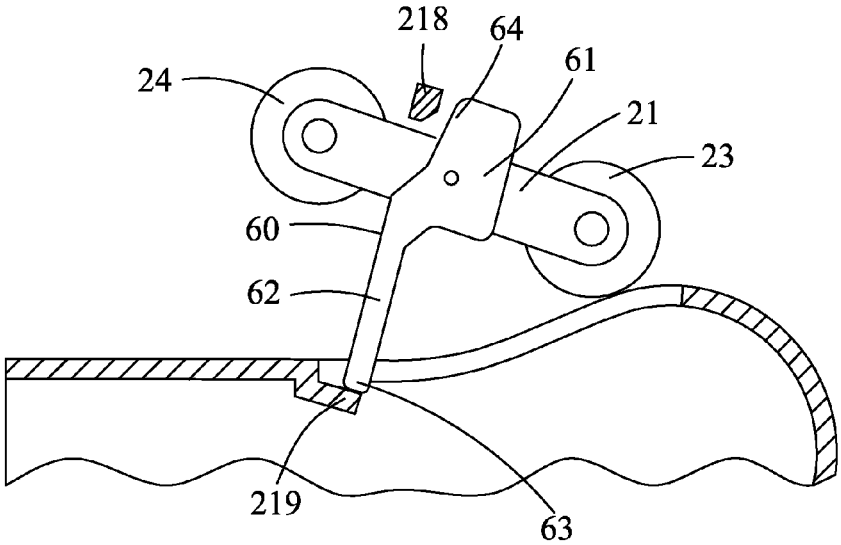
FIG. 17 shows a third preferred embodiment of the document picking up means in a status of preparing for putting documents according to the present invention.
Figure 18:
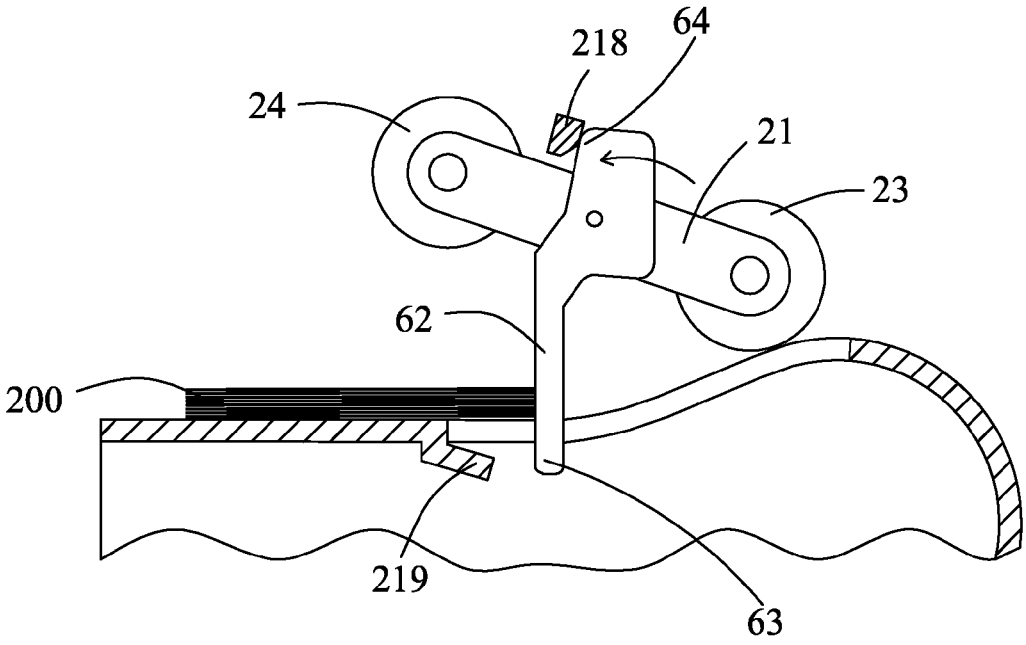
FIG. 18 shows the third preferred embodiment of the document picking up means in a status of preparing for picking up documents.
Figure 19:
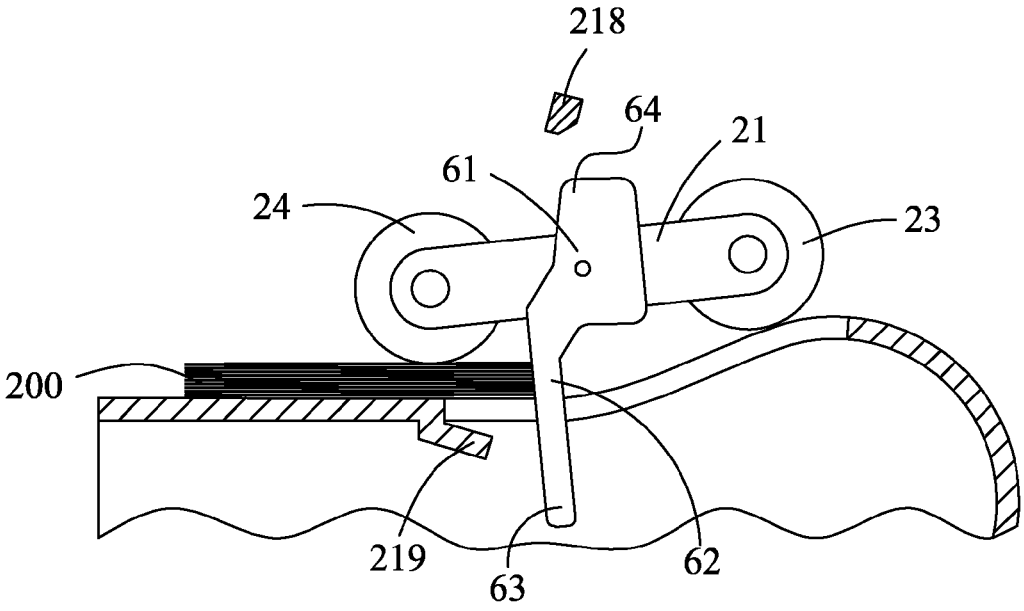
FIG. 19 shows the third preferred embodiment of the document picking up means in document feeding status.
Figure 20:
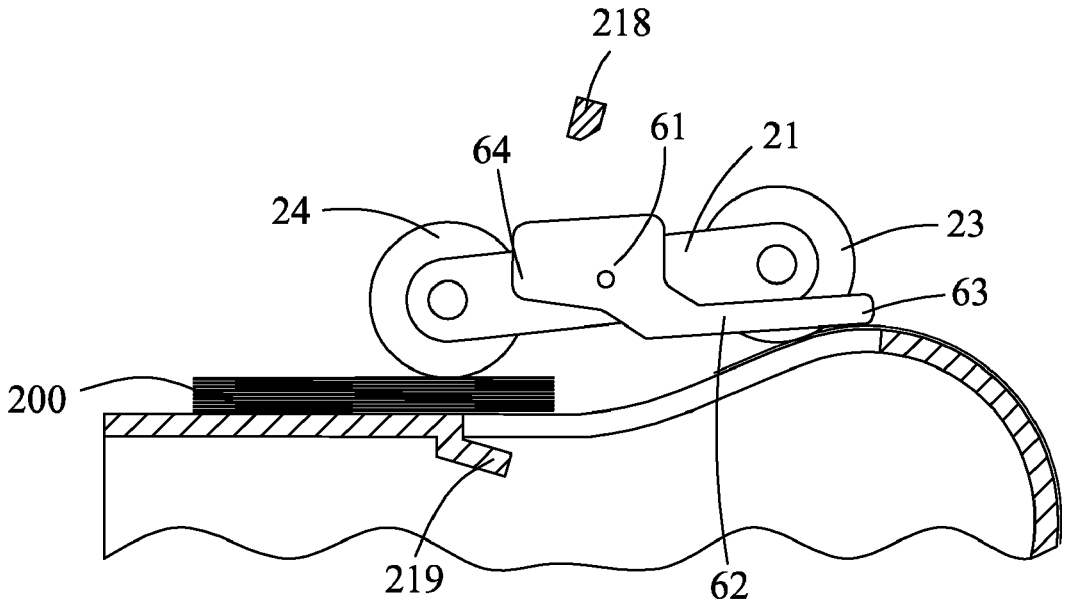
FIG. 20 shows the third preferred embodiment of the document picking up means in document separating status.

Please refer to FIG. 17 to FIG. 20 showing a third preferred embodiment of the document picking up means 20 and a third preferred embodiment of the stopper means 60. The second preferred embodiment of the document picking up means 20 includes the supporting frame 21, the document picking up unit 24, the document separating unit 23, a third blocking portion 218 formed at the cover 11 and a third supporting portion 219 formed at the upper guider 12. Especially, the third blocking portion 218 is separated from the third supporting portion 219.

The third preferred embodiment of the stopper means 60 includes a connection portion 61, a blocking arm 62 extended downwardly from the connection portion 61, a lower restricting arm 63 extended downwardly from the blocking arm 62 and an upper restricting arm 64 extended upwardly from the connection portion 61.

The connection portion 61 couples to the supporting frame 21 of the document picking up means 20. If the document picking up means 20 works in the status of preparing for putting documents, then the document picking up means 20 can be raised at the predetermined level. The lower restricting arm 63 is abutted against and supported by the third supporting portion 219 to improve the reliability of the document picking up means 20. The upper restricting arm 64 is separated from the third blocking portion 218.

If the documents are put on the document supporting platform 121, then the blocking arm 62 of the stopper means 60 will be pushed rearward. Since, the lower restricting arm 63 is brought to rotate to separate from the third supporting portion 219 and, the upper restricting arm 64 is brought to rotate toward the third blocking portion 218. Then, the upper restricting arm 64 abuts against the third blocking portion 218 to restrict rotation of the stopper means 60. Since, the documents can be blocked by the blocking arm 62 of the stopper means 60.

The processor judges the document picking up means 20 works in the status of preparing for picking up documents by motoring the sensor 40. If the document picking up means 20 works in the status of picking up documents, then the document picking up means 20 will be driven to droop. The upper restricting arm 64 of the stopper means 60 is moved downwardly according with movement of the document picking up means 20 to separate from the third blocking portion 218.

The picking up roller 242 of the document picking up unit 24 is brought to connect the document for picking up the document. Because the upper restricting arm 64 is not blocked by the third blocking portion 218, the document is conveyed by the picking up roller 242 to push the blocking arm 62 and toward the document separating unit 23.

As described above, the document feeding means 20 is kept at the predetermined level via the supporting portion 215/216/

219 abuts against the restricting arm 33/53/63 of the stopper means 30/50/60 for supporting the document feeding means 20. Since, the document feeding mechanism 100 has high reliability to resist shake and crash for preventing the document picking up means 20 from being drooped.

Furthermore, the present invention is not limited to the embodiments described above; diverse additions, alterations and the like may be made within the scope of the present invention by a person skilled in the art. For example, respective embodiments may be appropriately combined.

What is claimed is:

1. A document feeding mechanism comprising:

a frame comprising a cover and a document guiding frame;

a document picking up means comprising a supporting frame coupled to the cover of the frame for picking up and conveying a document;

a stopper means coupled to the document guiding frame for blocking the conveyance of the document;

a supporting portion formed at the supporting frame of the document picking up means and cooperating with the stopper means for supporting the document picking up means while the document picking up means is raised at a predetermined level; and a blocking portion formed at the supporting frame of the document picking up means and restricting a rotatable angle of the stopper means for blocking the conveyance of the document while the document picking up means is raised at the predetermined level.

2. The document feeding mechanism as claimed in claim 1, wherein the supporting portion is formed at a front portion of the support frame, the blocking portion is formed behind the supporting portion, the blocking portion is separated from the supporting portion to keep a space.

3. The document feeding mechanism as claimed in claim 2, wherein the supporting frame of the document picking up means supports a document picking up unit at the front portion thereof and a document separating unit at a rear portion thereof, the document feeding means pivots on the document separating unit to raise the document picking up unit at the predetermined level.

4. The document feeding mechanism as claimed in claim 3, wherein the stopper means comprises a connection coupled to the document guiding frame and a restricting arm extended upwardly from the connection portion for supporting the supporting portion of the document picking up means while the document picking up means is raised at the predetermined level.

5. The document feeding mechanism as claimed in claim 4, wherein the stopper means is pushed by the document to urge the restricting arm to separate from the supporting portion and move to abut against the stopper means capable of restricting the rotatable angle of the stopper means for blocking the conveyance of the document.

6. The document feeding mechanism as claimed in claim 5, wherein the document picking up unit is drooped to pick up and convey the document, the blocking portion and the supporting portion are moved below the restricting arm according with movement of the document picking up means to urge the restricting arm of the stopper means to pass through the space between the blocking portion and the supporting portion, the document conveyed by the document picking up unit pushes the stopper means to urge to the restricting arm to move beyond the blocking portion.

7. The document feeding mechanism as claimed in claim 6, wherein the document picking up unit comprises a shaft and a picking up roller surrounding the shaft of the document picking up unit, the document separating unit comprises a shaft and a separating roller surrounding the shaft of the document separating unit, the document feeding means pivots on the shaft of the document separating unit to raise the document picking up unit at the predetermined level.

* * * * *